United States Patent [19]

Noguchi

[11] 4,274,094

[45] Jun. 16, 1981

[54] CATHODE-RAY TUBE DISPLAY APPARATUS

[75] Inventor: Satoshi Noguchi, Fujisawa, Japan

[73] Assignee: Matsushita Electric Industrial Co., Ltd., Kadoma, Japan

[21] Appl. No.: 45,766

[22] Filed: Jun. 5, 1979

[30] Foreign Application Priority Data

Jun. 13, 1978 [JP] Japan ..... 53-71709

[51] Int. Cl.[3] ..... G08B 5/36

[52] U.S. Cl. ..... 340/723; 340/793

[58] Field of Search ..... 340/723, 793, 748; 315/383

[56] References Cited

U.S. PATENT DOCUMENTS

| | | | |
|---|---|---|---|
| 2,997,620 | 8/1961 | Katzmann | 315/383 |
| 3,336,587 | 8/1967 | Brown | 340/723 |
| 3,473,082 | 10/1969 | Kolodnyckij | 340/723 X |
| 4,177,409 | 12/1979 | Chamberlin | 315/383 |

*Primary Examiner*—David L. Trafton

*Attorney, Agent, or Firm*—Cushman, Darby & Cushman

[57] ABSTRACT

Provided in a video amplifier circuit in accordance with the present invention is a first switching element which receives input video signals and makes a switching action, a second switching element which receives input dual intensity signals for shifting the intensity level of selected parts of the images, and a video signal amplifying stage. Also provided is a variable voltage feeding circuit, a power supply terminal, a transistor connected by its collector substantially to said power supply terminal and by its emitter to an output terminal of said first switching element and to an input terminal of said video signal amplifier stage, a diode connected between a variable voltage output terminal of said variable voltage feeding circuit and the base of said transistor in the direction backward to that of the base current of said transistor and a base resistor connected to said base to feed the base current of said transistor whereby the display intensity of the accentuated brighter characters is made free from adjustment setting of the display intensity of the non-accentuated characters and the highest display intensity of the non-accentuated characters is made the same as that of the accentuated characters.

14 Claims, 8 Drawing Figures

CATHODE-RAY TUBE DISPLAY APPARATUS

BACKGROUND OF THE INVENTION

1. Field of Invention

The present invention relates to a video amplifier circuit for cathode-ray tube display monitors which are used as output display terminals (computer peripherals) or for other display purposes.

2. Prior Art

In cathode-ray tube (abbreviated as CRT hereinafter) display monitors, when characters, symbols, or graphics are displayed, it is often required to accentuate some parts of the display. A dual intensity display mode, whereby the parts desired to be accentuated are displayed with a higher intensity level and the remaining parts not to be accentuated are displayed with a lower intensity level, is commonly used for this purpose.

In this dual intensity display mode, it is desirable that the intensity difference between the accentuated parts and the remaining parts on the display CRT is continuously adjustable with a control knob provided, for example, on a front panel of the display monitor apparatus. However, signals processed in digital circuits such as used in computers have normally only two discrete levels: High Level (called "H" hereinafter) and Low Level (called "L" hereinafter). Achieving the intensity difference adjustment mentioned above with signals of two discrete levels presents certain difficulties in designing circuits of such the display monitor apparatus and inconveniences described later in their operation.

In the following the configuration of a typical approach of the prior art and its drawbacks are explained. FIG. 1 shows an example of the display on a CRT screen in the dual intensity display mode. In this example, for simplicity, only characters are displayed. Therefore, hereinafter the word "character" is to be understood to represent symbol or graphic element also. The characters with boldface letters represents those characters which are accentuated with a higher display intensity level from the remaining non-accentuated characters with a lower display intensity level, which are represented with lightface letters.

Hereupon, in the relation to the later explanations, the principle of generating and displaying characters on the CRT screen is simply explained below. In the CRT display using raster scan TV mode, the individual characters are generated with appropriately located combination of dot matrix elements as shown in FIG. 2, wherein a capital letter A is shown as an example with the 5 by 7 dot matrix. Dot matrix elements of each same row are scanned by a single horizontal scan of an electron beam of the CRT. Those dot matrix elements which are to be in a "H" state are brightened. The whole character comprizes seven horizontal scanning lines "H1" to "H7". The dot matrix elements in the "H" state on these seven scanning lines, shown by the solid circles (black circles), form a capital letter A, and the rest of the matrix elements, in the "L" state, shown by the open circle (white circles), remain unbrightened.

Now, for explaining the operation of the dual intensity display mode, the character-generating video signal (also referred to herein as an "output" character-generating video signal, to be distinguished from the "input" character-generating video signal (see below)) and the dual intensity signal are shown in FIG. 3, wherein (a) shows the character-generating video signal in the dual intensity display mode appearing on a certain scanning line, and (b) shows the dual intensity signal which appears with taking the synchronism to the character-generating video signal. The high level portions of the character-generating video signal correspond to the brightened dot matrix elements which form the displayed characters. During the time periods when the dual intensity signal is kept to "H" state, the height of the high level portions of the character-generating video signal are held to a value designated as "$H_H$". During the time periods when the dual intensity signal is kept to "L" state, the height of the high levels portion of the character-generating video signal are held to a value designated as "$H_L$" which is lower than "$H_H$". Therefore, characters generated from the dot matrix elements corresponding to the "$H_H$" portions of the character generating video signal are accentuated by their display intensity on the CRT screen from those characters generated from the dot matrix elements corresponding to the "$H_L$" portion of the output character generating video signal in accordance with the "H" or "L" state of the dual intensity signal.

Means for displaying the characters with dual intensity by the abovementioned method using the combination of the character-generating video signal and the dual intensity signal are known, and a conventional circuit which has widely been used heretofore is shown in FIG. 4. In this circuit, two digital switching elements (formed in ICs and called generally AND-gates) $IC_1$ and $IC_2$ are used. Input terminals A and B are connected in such a manner that the two input terminals of the $IC_1$ are connected to terminal A, one another, and an input terminal of $IC_2$. The other input terminal of the $IC_2$ is connected to terminal B, as shown in the circuit diagram. And to the terminals A and B, an input character generating video signal and the dual intensity signal are applied, respectively. The output terminals of the AND-gates $IC_1$ and $IC_2$ are connected through a potentiometer type variable resistor $VR_1$ to each other, and the character-generating signal is taken from its sliding tap terminal c. An example of the internal circuit configuration of the AND-gate IC's, $IC_1$ and $IC_2$ is shown in FIG. 5, wherein $IN_1$ and $IN_2$ represent the two input terminals of $IC_1$ and $IC_2$ or OUT represents the output terminal thereof. The detailed explanation of the operation of various parts of this circuit is omitted here, although the relevant function of this circuit to the operation of the external whole circuit is explained below. Only when both input terminals $IN_1$ and $IN_2$ are held in "H" state, a transistor $TR_5$ turns on while a transistor $TR_6$ turns off. A output terminal OUT is held in "H" state. When any one of remaining combinations of "H" and "L" other than the abovementioned occurs at the two input terminals $IN_1$ and $IN_2$, transistor $TR_5$ turns off and the transistor $TR_6$ turns on, whereby the output terminal OUT is held "L". Thus the AND-gate function by the IC is attained.

The principle of the operation of the conventional circuit shown in FIG. 4 is explained below. In this explanation, the effect of any internal resistance inside the AND-gates $IC_1$ and $IC_2$ is neglected.

First, when the dual intensity signal applied to the input terminal B is held to "H" state, as can be understood by the circuit connection between the input terminals A, B and each input terminal of two AND-gates $IC_1$, $IC_2$ shown in FIG. 4, $IC_1$ and $IC_2$ act in the same manner in accordance with the input character-generating video signal applied to the terminal A. That is, when the input character generating video signal is in "H" state, outputs of both AND-gates $IC_1$ and $IC_2$ are at "H" level; and when the input character-generating video signal is at "L" state, outputs of both $IC_1$ and $IC_2$ are in "L" level. Because of this simultaneously changing actions of two AND-gates $IC_1$ and $IC_2$, potentials at both ends of the potentiometer type resistor $VR_1$ remain at the same value, therefore the potential at the sliding tap terminal c is also kept at the same values as at the both ends of $VR_1$ regardless of the position of the sliding tap of the potentiometer $VR_1$. Then, even if the sliding tap position of $VR_1$ is adjusted, the signal at the terminal c varies only between fixed "H" and "L" levels in accordance with the input character-generating video signal applied to the terminal A.

Next, when the dual intensity signal applied to the terminal B is held in "L" state, since the output of $IC_2$ is always kept to "L" level regardless of "H" or "L" state of the input character-generating video signal, potential at the lower end of $VR_1$, i.e., of the end connected to $IC_2$, is maintained at "L" level. On the other hand, potential at the $IC_1$-side end of $VR_1$ varies between "H" and "L" levels in accordance with the input character-generating video signal. Then the value of the high level portion of the signal at the terminal c is a certain midway value between the "H" and "L" levels depending upon the position of the sliding tap of $VR_1$.

As the result of the above-described operation of the AND-gates $IC_1$, $IC_2$ and the potentiometer type variable resistor $VR_1$, the signal at the terminal c acts as the character-generating video signal in the dual intensity display mode shown by FIG. 3(*a*). Namely the high level of the signal at the terminal c during the period of time when the dual intensity signal is kept to "H" state, corresponds to the high level portion "$H_H$" of FIG. 3(*a*); and the high level during the period of time when the dual intensity signal is kept to "L", corresponds to the lower high level portion "$H_L$" of FIG. 3(*a*). That is, the high level "$H_H$" is a fixed high level, being independent of the adjustment of $VR_1$, the high level "$H_H$" forming the accentuated characters with a fixed high display intensity on the CRT; while the lower high level "$H_L$" is a variable high level, being adjustable to lower than "$H_H$" with $VR_1$, the lower high level "$H_L$" forming the non-accentuated characters with a variable lower display intensity on a CRT screen. It should be noted that in the dual intensity display monitors such as described above, the display intensity of the accentuated characters is fixed, while that of the non-accentuated characters can be lowered than that of the accentuated characters by the adjustment.

In the circuit shown in FIG. 4, the character-generating video signal in the dual intensity display mode, obtained thus as an output at the terminal c, is fed through a base resistor $R_{10}$ to a video amplifier stage, which comprises transistors $TR_{10}$ and $TR_{11}$ and amplifies up to a level sufficient to drive a display CRT 1. $R_{11}$ is an emitter resistor, $R_{12}$ and $R_{13}$ are bias resistors, $R_{14}$ is a collector resistor, and $C_{10}$ is a base bias capacitor. The video amplifier stage is constructed so as to provide a flat wide band amplification from low frequencies up to high video frequencies by combining an emitter-grounded amplifier comprising the transistor $TR_{10}$ with a base-grounded amplifier comprising the transistor $TR_{11}$.

In the above explanation of the video amplifier circuit, which has been used heretofore in conventional dual intensity CRT display monitor, an idealized behavior of the circuit has been described. This idealization neglects the internal resistance of ICs which inevitably exists in real circuits. When considering this conventional circuit with the internal resistance, that is, in the real operation of the conventional video amplifier circuit with the dual intensity display function of FIG. 4, several undesirable points are present as will be mentioned later. On the other hand, the desirable points for the CRT display monitor with the dual intensity display mode are as follows:

(1) The display intensity of the non-accentuated characters can be adjusted fully between that of the accentuated characters and zero intensity. When the adjustment for the display intensity of the non-accentuated characters is set to the full intensity level, the non-accentuated characters, which are set by a certain programmed or data-controlled command, can be displayed in the same intensity as that of the accentuated characters: (the display intensity difference between the accentuated and non-accentuated characters is extinguished). On the other hand, when the adjustment for the display intensity of the non-accentuated characters is set to the zero intensity, only the non-accentuated characters can be erased completely from the CRT display.

(2) Even when the display intensity of the non-accentuated characters is changed by the adjustment operation, the display intensity of the accentuated characters is maintained at a fixed constant level, which is the highest level even when the display intensity of the non-accentuated characters is set to the highest level.

(3) If care is taken, it is possible to avoid the deterioration of the rise and fall characteristics of the character-generating video signal due to stray capacitance of cables. A cable connects a circuit board part, which contains the circuit of FIG. 4, to the potentiometer $VR_1$, which is usually placed near the front panel of the apparatus separated from the circuit board part to facilitate control thereof.

When the internal resistance inevitably existing in circuit elements is taken into account, existing dual intensity CRT display monitor using the conventional circuit of FIG. 4 have the following undesirable points:

(1) The highest display intensity of the non-accentuated characters cannot be adjusted fully up to that of the accentuated characters. Since the $IC_2$-side end of the potentiometer $VR_1$ is grounded, when the dual intensity signal is kept to "L" for displaying the non-accentuated characters, the current flowing through the potentiometer $VR_1$ from its $IC_1$-side end to $IC_2$-side end becomes large. Namely, the potential at the $IC_1$-side end of the potentiometer $VR_1$ cannot be kept to "$H_H$" level due to the internal resistance of $IC_1$, even when the input character generating video signal is in "H" state. Therefore, even when the sliding tap of the potentiometer $VR_1$ is adjusted up to the $IC_1$-side end of $VR_1$ for highest intensity display, the display intensity of the non-accentuated characters cannot be raised up to the intensity level of the accentuated characters. This inconvenience can be relieved to some extent but not eliminated by selecting a rather large resistance value for $VR_1$.

(2) When the display intensity of the non-accentuated characters is changed by the adjustment of the potentiometer $VR_1$, the display intensity of the accentuated character cannot be maintained at a fixed highest level. Adjustment of the sliding tap of $VR_1$ for lowering the display intensity level of the non-accentuated characters causes an increase in the load resistance for $IC_1$, thereby decreasing the potential at the $IC_1$-side end of the potentiometer $VR_1$ depending upon the position of the sliding tap the potentiometer of $VR_1$ due to the internal resistance of $IC_1$. Therefore, even when the $IC_2$-side end of the potentiometer $VR_1$ is held to "H" level by "H" state of the dual intensity signal for accentuated characters, the output signal at the terminal c decreases from its highest level "$H_H$" depending upon the adjustment of the potentiometer $VR_1$. Consequently the display intensity of the accentuated characters cannot be maintained at the high level which corresponds to the adjustment of the display intensity of the non-accentuated characters.

(3) Since cables connecting a circuit board part to the potentiometer $VR_1$, which is usually placed near the front panel of the apparatus separated from the circuit board part to facilitate control thereof, are often lengthy, the stray capacitance of those cables inevitably becomes large. This causes the deterioration of the rise and fall characteristics of the input character-generating video signal. This deterioration is emphasized particularly when the resistance value of $VR_1$ is selected to be a large value for promoting the greatest possible equality of the highest display intensity of the non-accentuated characters to the display intensity of the accentuated characters.

SUMMARY OF THE INVENTION

The object of the present invention is to remove the abovementioned drawbacks which are present in the conventional circuits used heretofore and to offer a novel video amplifier circuit for the CRT display monitors having the function of the dual intensity display which has the following features:

(1) The display intensity of the non-accentuated characters can be adjusted fully between that of the accentuated characters and zero intensity.

(2) Even when the display intensity of the non-accentuated characters is changed by the adjustment operation, the display intensity of the accentuated characters should be maintained at a fixed highest level.

(3) The rise and fall characteristics of the output character-generating video signal is not deteriorated due to the placement of a separately located control device for the display intensity adjustment of the non-accentuated characters.

DETAILED DESCRIPTION OF THE PREFERRED EMBODIMENT

Figure 1:
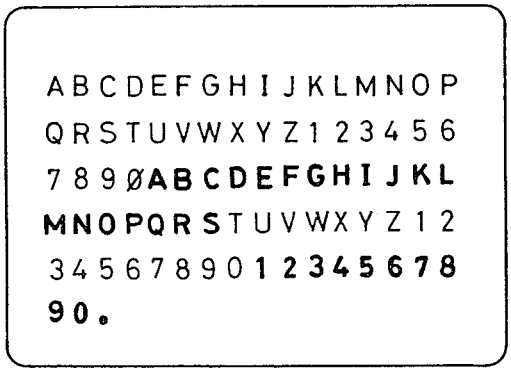
FIG. 1 is a schematic drawing illustrating generally accentuated and non-accentuated characters appearing on a CRT display monitor.
Figure 2:
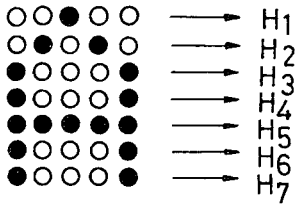
FIG. 2 is a schematic example of a pattern configuration necessary for generating characters such as those in the display shown in FIG. 1.
Figure 3:
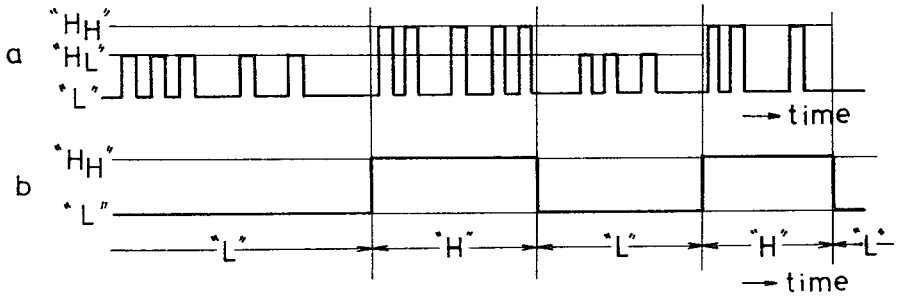
FIG. 3 is a drawing showing generally pulse patterns of necessary signals which must be supplied to a displaying CRT for performing the character display such as shown in FIG. 1 based on the character-generating pattern configuration such as shown in FIG. 2.
Figure 4:
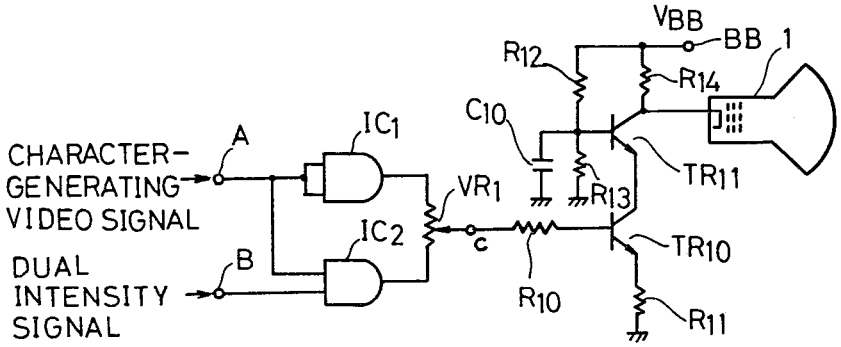
FIG.4 (Prior Art)
FIG. 4 is an example of conventional video amplifier circuits used heretofore for the CRT display.

The present invention avoids the drawbacks which has been present in the conventional video amplifier circuit used heretofore for the CRT display monitors, and thereby provides a high quality CRT monitor display having the dual intensity function. A video amplifier circuit in accordance with the present invention comprises:

- a first switching element which receives input video signals and makes a switching action responding to said input video signal,
- a second switching element which receives input dual intensity signals for shifting the intensity level of selected parts of the image displayed on a screen of said cathode ray tube into a brighter accentuated intensity level and a darker non-accentuated intensity level,
- a video signal amplifying stage and
- a variable resistor for adjusting intensity level,
- wherein said variable resistor is connected by both ends thereof between an output terminal of said second switching element and a power supply terminal. The video amplifier circuit in accordance with the present invention also comprises
- a transistor connected by its collector substantially to said power supply terminal and by its emitter to an output terminal of said first switching element and to an input terminal of said video signal amplifier stage,
- a diode connected between a variable voltage output terminal of said variable voltage feeding circuit and the base of said transistor, the direction of said diode being backward to the direction of the base current of said transistor and
- a base resistor connected to said base to feed the base current of said transistor.

With the above constitution, the video amplifier circuit in accordance with the present invention has the following features:

(1) Output ends of two switching elements ($IC_1$ and $IC_2$) used for the respective controls of the character-generating video signal and of the dual intensity signal are connected to each other through a variable voltage feeding circuit comprising a potentiometer or variable resistor ($VR_{11}$) for the adjustment of the display intensity of the non-accentuated characters, a diode ($D_1$) and a transistor ($TR_{12}$). The forward direction of the diode ($D_1$) is selected in a manner such that it substantially isolates two switching elements ($IC_1$ and $IC_2$) when the dual intensity signal is held to the "H" state. This assures that the display intensity for the accentuated characters does not depend on the adjustment setting of the display intensity of the non-accentuated characters.

(2) With proper choice of said variable resistor ($VR_{11}$) or by providing with the variable range adjusting resistors on both sides of said variable resistor, it is possible to bias said diode ($D_1$) reversely within the adjustment range of said variable resistor. This assures that the highest display intensity of the non-accentuated characters, which is realized by the setting of said variable resistor ($VR_{11}$) to the highest side, can be made substantially the same as the display intensity of the accentuated characters.

(3) The resultant dual intensity character-generating video signal is fed directly to a wide band video amplifier stage ($TR_{10}$) for driving a display CRT (1) without passing through said variable resistor ($VR_{11}$). This assures that the deterioration in the video signal characteristics due to the stray capacitance of connecting cables extending to said variable resistor ($VR_{11}$) does not take place.

In the following, the detailed explanation for embodiment examples are given in reference to FIGS. 6 to 8.

Figure 6:
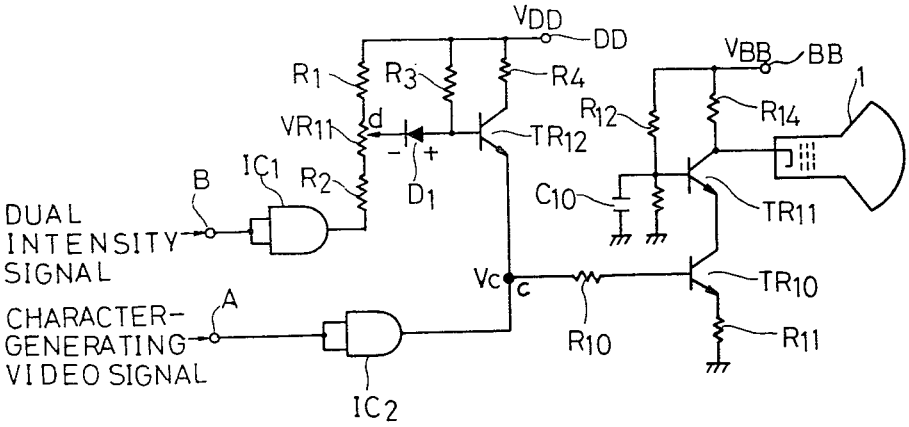
FIG. 6 is a circuit diagram of a preferred exemplary embodiment of a video amplifier circuit for the CRT display in accordance with the present invention.

In FIG. 6, $IC_1$ and $IC_2$ are AND-gate switching elements. A dual intensity signal input terminal B is connected to commonly connected input terminals of the AND-gate $IC_1$. An output terminal of the AND-gate $IC_1$ is connected through resistor $R_2$, a potentiometer type variable resistor $VR_{11}$, and a resistor $R_1$ to a positive-side terminal DD of a power supply. The character-generating video signal terminal A is connected to commonly connected input terminals of the AND-gate $IC_2$. The base of a transistor $TR_{12}$ is connected through a backward diode $D_1$ to a sliding tap terminal of the potentiometer type variable resistor $VR_{11}$ and also connected through a resistor $R_3$ to the terminal DD. The emitter of said transistor $TR_{12}$ is connected to an output terminal of the AND-gate $IC_2$. The collector of said transistor $TR_{12}$ is connected through $R_4$ to the terminal DD. The potentiometer type variable resistor $VR_{11}$ is for adjusting the "$H_L$" level, that is, for adjusting the display intensity of the non-accentuated characters. $R_1$ and $R_2$ are resistors for compensating the individual resistance value deviation of $VR_{11}$; in case that the extent of this deviation is small, they can be omitted. $R_3$ is a bias resistor, and $R_4$ is a current-limiting resistor. $D_1$ is a reverse-current preventing diode, and therefore, the direction of the diode $D_1$ is set backward to a current flowing through the diode and the base of the transistor $TR_{12}$. $TR_{12}$ is an output transistor. The signal obtained as an output at a point c, which is the junction point of the emitter of the transistor $TR_{12}$ and the output terminal of the $IC_2$, is fed through a base resistor $R_{10}$ to an input terminal of a video amplifier stage comprising of transistors $TR_{10}$ and $TR_{11}$ and amplified up to a level which is sufficient to drive a display CRT 1. Hereupon, $R_{11}$ is an emitter resistor, $R_{12}$ and $R_{13}$ are bias resistors, $R_{14}$ is a collector resistor, and $C_{10}$ is a base bias capacitor. The video amplifier stage is constructed so as to provide flat wide band amplification from low frequencies up to high video frequencies by combining an emitter-grounded amplifier comprising the transistor $TR_{10}$ with a base-grounded amplifier comprising the transistor $TR_{11}$.

Figure 5:
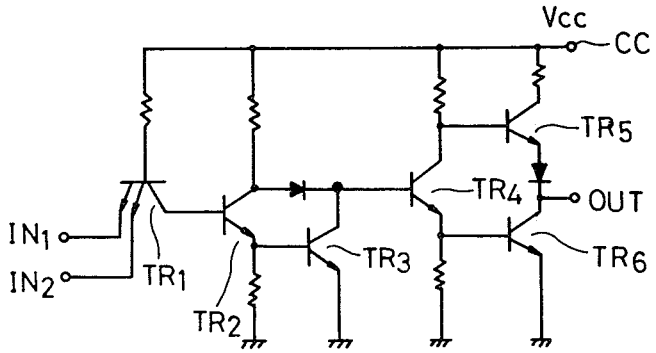
FIG.5 (Prior Art)
FIG. 5 is a circuit diagram showing the internal circuit of AND-gate switching elements $IC_1$ and $IC_2$ used in the conventional circuit of FIG. 4.
Figure 7:
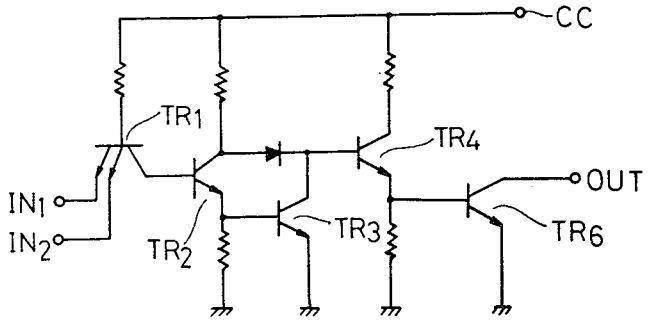
FIG. 7 is a circuit diagram showing the internal circuit of AND-gate switching elements $IC_1$ and $IC_2$ used in the circuit of FIG. 6.

FIG. 7 shows an example of the internal circuit configuration of the AND-gates $IC_1$ and $IC_2$, wherein the difference from FIG. 5 is that the output transistor $TR_5$ of FIG. 5 is omitted here. The AND-gate IC shown by FIG. 7 is an open-collector type. The AND-gate switching element of FIG. 5 can also be used in FIG. 6.

As can be understood from the internal circuit configuration of the AND-gate $IC_1$ of FIG. 7, in FIG. 6 showing the preferred exemplary embodiment of the present invention, when the dual intensity signal is held to "H"and applied, an output transistor $TR_6$ inside $IC_1$ becomes off. Accordingly, the potential at an output terminal OUT of $IC_1$ is held to $V_{DD}$, which is the voltage of the power supply appearing at the positive side terminal DD of the power supply. Therefore, the potential of the sliding tap terminal d becomes $V_{DD}$, whereas the base voltage of $TR_{12}$ is less than $V_{DD}$ because of the voltage drop across $R_3$ due to the base current flowing through $TR_{12}$. Therefore the diode $D_1$ is reversely biased, and hence is in cut off state. Since the diode $D_1$ is in cut off state, the potential $V_c$ at the point c depends only upon the output signal level of another AND-gate $IC_2$ to which the character-generating video signal is applied. That is, when the input character-generating video signal is held to "H" state, the potential $V_c$ at the point c is given by $V_c \approx V_{DD} - V_{BE(TR12)}$, since the voltage drop across $R_3$ and $R_4$ can be neglected. When the character-generating video signal is held to "L" state, through the output transistor $TR_6$ in $IC_2$ a saturation current flows, and the output terminal OUT of $IC_2$ is substantially grounded, that is, the potential $V_c$ at the point c is given by $V_c = V_{CE(SAT)(IC2)} \approx 0V$. Here, $V_{BE(TR12)}$ is the base-emitter voltage of the transistor $TR_{12}$, and $V_{CE(SAT)(IC2)}$ is the saturation voltage of the transistor $TR_6$ of $IC_2$. Thus the output character-generating video signal at the point c varies following the input character-generating video signal applied to the terminal A when the dual intensity signal applied to the terminal B is "H".

The abovementioned operation of this circuit is not influenced by the position of the sliding tap of $VR_{11}$, which is used for adjusting the display intensity of the non-accentuated characters, as long as the dual intensity signal is held to "H" state, because under this condition the output circuit of $IC_1$ is held to the cut-off state and hence the potential of any portion of $VR_{11}$ is kept to $V_{DD}$. This assures that with this circuit the display intensity of the accentuated characters is held to a fixed constant level regardless of the adjustment of the display intensity of the non-accentuated characters.

Next, when the dual intensity signal is in "L" state, output of the AND-gate $IC_1$ is held to "L" level, that is, to zero level. Accordingly, the potential at the sliding tap terminal d of $VR_{11}$ becomes a divided voltage which is made by dividing tthe voltage $V_{DD}$ by the dividing ratio of the voltage dividing network of $R_1$, $VR_{11}$, and $R_2$. In this state of operation, when the character-generating video signal is in a "H" state, the potential $V_c$ at the point c is expressed as $$V_c = V_d + V_{D1} - V_{BE(TR12)},$$

which in derived from the relation of the voltages in a circuit path from the point d through the diode $D_1$ and the base-to-emitter of the transistor $TR_{12}$ to the point c, where $V_d$ is a potential at the point d and $V_{D1}$ is a forward drop voltage of the diode $D_1$.

Since both $V_{D1}$ and $V_{BE}$ are the forward drop voltage at the junction, they are almost the same value. Accordingly, by letting $V_{D1} \approx V_{BE(TR12)}$, the above equation becomes $V_c \approx V_d$. That is, the voltages at the point c and the point d are the same. Therefore the voltage $V_c$ at the point c can be adjusted by adjusting the voltage $V_d$ at the point d by controlling the sliding tap of the variable resistor $VR_1$. Of course, when the character-generating video signal is in "L" state, the voltage $V_c$ at the point c is, as previously described, expressed as $$V_c = V_{CE(SAT)(IC2)} \approx 0V.$$

Therefore, the output character-generating video signal appearing at the point c can be varied from zero up to the "$H_L$" level, which corresponds to the $V_c$ value at the time when $V_c \approx V_d$. Thus the "$H_L$" level, that is, the display intensity of the non-accentuated characters, can be varied by controlling the position of the sliding tap of $VR_{11}$.

If the combination of those resistance values, $R_1$, $VR_{11}$ and $R_2$ is so selected that the cut-off of the diode $D_1$ takes place at the uppermost setting of the position of the sliding tap of $VR_{11}$; the display intensity of the non-accentuated characters for the abovementioned uppermost setting of $VR_{11}$ becomes the same as that of the accentuated characters, owing to the cut-off state of the diode $D_1$. Similarly, it is also possible to select the combination of the resistance values of $R_1$, $VR_{11}$, and $R_2$ in a manner that the lowermost setting of the sliding tap of $VR_{11}$ corresponds to the zero display intensity of the non-accentuated characters. Thus the full adjustment of the display intensity for the non-accentuated characters from zero intensity up to the intensity of the accentuated characters is possible in this circuit.

Furthermore, since the character-generating video signal is not fed to $VR_{11}$, the deterioration in the video signal characteristics to be caused by $VR_{11}$ due to its remote location from the circuit board part, as is usually the case in the conventional circuit, can be avoided. Of course, in this circuit, the dual intensity signal is fed to $VR_{11}$, but its maximum repetition frequency is much lower than that of the character-generating video signal. Therefore, the deterioration of the video signal characteristics due to stray capacitance of the wiring to the remote variable resistor $VR_{11}$ is much less than that in the conventional circuit.

Figure 8:
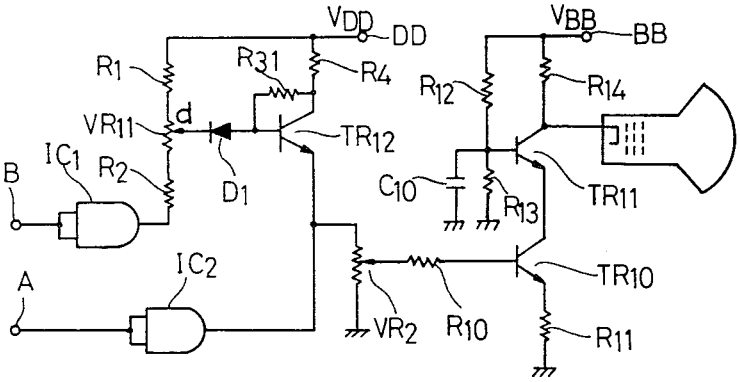
FIG. 8 is a circuit diagram showing another preferred exemplary embodiment example of the present invention.

FIG. 8 shows another preferred exemplary embodiment of the present invention, which differs from FIG. 6 in that the resistor $R_{31}$ is connected between the collector and the base of the output transistor $TR_{12}$. Also, another potentiometer type variable resistor $VR_2$, which is not present in the circuit of FIG. 6, is inserted to provide compensation against the individual deviations existing in the characteristics of the video signal amplifier stage I may be omitted. In this circuit configuration, when the output of the AND-gate $IC_2$ is in "L" level, the volage at the collector of the output transistor $TR_{12}$ also becomes low, and hence, the base current $I_B$ of the transistor $TR_{12}$ is decreased. Therefore, by suitably adjusting the values of the resistors $R_3$ and $R_4$ appropriately, a feedback action for the transistor $TR_{12}$ having a ratio $I_C/I_B$ of the collector current $I_C$ to the base current $I_B$ constant can be obtained. Therefore, when the transistor $TR_{12}$ is turned on, the ratio $I_C/I_B$ becomes constant, and hence, it becomes possible to maintain the base current $I_B$ of the transistor $TR_{12}$ constant. That is, the amount of electrons stored in the base region of the transistor $TR_{12}$ can be made to correspond to the change of the collector current $I_C$. Accordingly, the charge-up time of the excess electrons in the base region of the transistor $TR_{12}$ caused by an excess base current in the transistor $TR_{12}$ can be remarkably shortened, thereby eliminating deterioration in the character-generating video signal.

As has been explained above, with the circuits in accordance with the present invention shown in FIGS. 6 and 8, the drawbacks which have been present in the conventional circuit used heretofore are removed. The desired functions described above for the video amplifier circuit of CRT display monitors having the dual intensity display function can be realized, and thereby a high quality and convenient CRT character display can be offered.

What I claim is:

1. A video amplifier circuit for cathode ray tube display apparatus comprising:
   - a cathode ray tube,
   - a first switching element for receiving an input video signal and for making a switching action in response to said input video signal,
   - a second switching element for receiving an input dual intensity signal for shifting the intensity level of selected parts of the images displayed on a screen of said cathode ray tube into a brighter accentuated intensity level and a darker non-accentuated intensity level, and
   - a video signal amplifying stage,
   - a variable voltage feeding circuit comprising a variable voltage dividing circuit connected between an output terminal of said second switching element and a power supply terminal,
   - a transistor connected by its collector substantially to said power supply terminal and by its emitter to an output terminal of said first switching element and to an input terminal of said video signal amplifying stage,
   - a diode connected between a variable voltage output terminal of said variable voltage feeding circuit and the base of said transistor, the direction of said diode being backward to the direction of the base current of said transistor, and
   - a base resistor connected to said base to feed the base current of said transistor.

2. A video amplifier circuit for cathode ray tube display apparatus in accordance with claim 1 wherein said base resistor is connected between the base of said transistor and said power supply.

3. A video amplifier circuit for cathode ray tube display apparatus in accordance with claim 1 wherein said base resistor is connected between the collector and the base of said transistor.

4. An amplifier circuit for implementing a dual intensity display function of a video display apparatus, comprising:
   - means responsive to a dual intensity signal for obtaining a reference voltage having a first predetermined value when said dual intensity signal is indicative of high intensity operation, and having a controllably variable value variable between at least a predetermined value corresponding to a predetermined lowest intensity and a predetermined value corresponding to a predetermined highest intensity when said dual intensity signal is indicative of low intensity operation;
   - means for generating a control voltage, said control voltage generating means being isolated from said reference voltage obtaining means and said control voltage having a second predetermined value when the value of said reference voltage is said first predetermined value, and said control voltage generating means being responsive to said reference voltage and said control voltage having a value substantially equal to said variable value when said reference voltage is said variable value;
   - means responsive to an input character-generating signal and to said control voltage for obtaining an output character-generating signal, said output character-generating signal having a third predetermined value when said input character-generating signal is indicative of the absence of character generation, and having a value equal to said control voltage when said input character-generating signal is indicative of the presence of character-generation; and a video signal amplifying stage responsive to said output character-generating signal for driving a display device at intensities determined in accordance with said output character-generating signal.

5. The amplifier circuit of claim 4, wherein said first predetermined value, said second predetermined value, and said predetermined value corresponding to a predetermined highest intensity are substantially equal to a source potential; and said third predetermined value and said predetermined value corresponding to a predetermined lowest intensity are substantially equal to a ground potential.

6. The amplifier circuit of claim 4 or 5 wherein said reference voltage obtaining means comprises a controllably variable voltage divider having a source potential applied to one fixed terminal thereof, said reference voltage being obtained at a tap terminal thereof and another fixed terminal thereof being controlled in accordance with said dual intensity signal.

7. The amplifier circuit of claim 6, wherein said reference voltage obtaining means further comprises a switching element responsive to said dual intensity signal for providing a substantially closed circuit to ground at the output thereof when said dual intensity signal is indicative of low intensity operation, the output of said switching element being connected to said another fixed terminal of said variable voltage divider.

8. The amplifier circuit of claim 7, wherein said switching element is further responsive to said dual intensity signal for providing a substantially open circuit to ground at the output thereof when said dual intensity signal is indicative of high intensity operation.

9. The amplifier circuit of claim 7, wherein said switching element is further responsive to said dual intensity signal for providing a voltage at the output thereof substantially equal to said source potential when said dual intensity signal is indicative of high intensity operation.

10. The amplifier circuit of claim 4 or 5, wherein said control voltage generating means comprises:

a voltage following circuit;

an input biasing resistor connected to the input of said voltage following circuit; and a diode connected to the input and said voltage following circuit at one end, said reference voltage being applied to another end thereof;

wherein said diode is reversed-biased when said reference voltage is said first predetermined value, said input biasing resistor causing said control voltage provided at the output of said voltage following circuit to have said second predetermined value; and said diode is forward-biased when said reference voltage is said variable voltage, said voltage following circuit thereby following said variable voltage applied through said diode for causing said control voltage provided at the output of said voltage following circuit to have substantially the same value as said variable voltage.

11. The amplifier circuit of claim 10, wherein said voltage following circuit comprises a transistor having the collector thereof connected to a source potential through a current limiting resistor, the base thereof being an input and the emitter thereof being the output.

12. The amplifier circuit of claim 4 or 5, wherein said output character-generating signal obtaining means comprises a switching element responsive to said input character-generating signal for providing a substantially closed circuit to ground at the output thereof when said input character-generating signal is indicative of the absence of character generation, said control voltage thereby being shunted to ground.

13. The amplifier circuit of claim 12, wherein said switching element is further responsive to said input character-generating signal for providing a substantially open circuit to ground at the output thereof when said input character-generating signal is indicative of the presence of character generation, said control voltage thereby establishing the value of said output character-generating signal.

14. An amplifier circuit for implementing a dual intensity display function of a video display apparatus, comprising:

a first switching element responsive to a dual intensity signal for providing a substantially closed circuit to ground at the output thereof when said dual intensity signal is indicative of low intensity operation;

a controllably variable voltage divider having a fixed terminal connected to a source potential and another fixed terminal coupled to the output of said first switching element, a tap terminal being the output thereof;

a diode coupled to said tap terminal;

an input biasing resistor coupled to said diode;

a voltage following circuit coupled to said diode and said biasing resistor, said voltage following circuit providing a voltage at the output thereof substantially equal to the value of the voltage at said tap terminal when the voltage value at said tap terminal forward-biases said diode, and providing a voltage at the output thereof substantially equal to the value of a source potential when the voltage value of said tap terminal reverse-biases said diode;

a second switching element having an output thereof coupled to the output of said voltage following circuit, said second switching element being responsive to an input character-generating signal for providing a substantially closed circuit to ground at the output thereof when said input character-generating signal is indicative of the absence of character-generation, the output of said voltage following circuit thereby being substantially coupled to ground; and further responsive to said input character-generating signal for providing a substantially open circuit to ground at the output thereof when said input character-generating signal is indicative of the presence of character generation, and a video signal amplifying stage coupled to the outputs of said voltage following circuit and said second switching element for driving a display device at intensities determined in accordance therewith.

* * * * *